US006012610A

United States Patent [19]

Pauser et al.

[11] Patent Number: 6,012,610

[45] **Date of Patent: *Jan. 11, 2000**

[54] DEVICE FOR EMPTYING A FILM TUBE

[75] Inventors: Helmut Pauser, Diessen; Gerd Brandhorst, Landsberg; Klaus Hammen, Gilching; Wolf-Dietrich Herold, Seefeld, all of Germany

[73] Assignee: Thera Patent GmbH & Co. KG Gesellschaft fur Industrielle Schutzrechte, Seefeld, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,103

[22] Filed: Feb. 5, 1997

[30] Foreign Application Priority Data

Feb. 5, 1996 [DE] Germany ..... 296 01 917 U
Apr. 16, 1996 [DE] Germany ..... 296 06 895 U

[51] Int. Cl.[7] ..... B65B 69/00

[52] U.S. Cl. ..... 222/88; 222/81; 222/105; 222/82; 222/107; 222/325; 141/330

[58] Field of Search ..... 222/81, 88, 105, 222/82, 107, 325, 541.2; 141/330, 329

[56] References Cited

U.S. PATENT DOCUMENTS

| | | | |
|---|---|---|---|
| 2,083,479 | 6/1937 | Speare | 222/107 |
| 3,367,353 | 2/1968 | Hunter | 222/105 |
| 3,482,258 | 12/1969 | Steen | 141/329 |
| 3,843,021 | 10/1974 | Schieser | 222/105 |
| 4,098,431 | 7/1978 | Palmer et al. | 222/88 |
| 4,120,420 | 10/1978 | Dirksing | 222/88 |
| 4,149,573 | 4/1979 | Cassia | 141/330 |
| 4,162,501 | 7/1979 | Mitchell et al. | 141/329 |
| 4,316,555 | 2/1982 | Smith | 222/105 |
| 4,391,309 | 7/1983 | Steiner | 141/330 |
| 4,491,244 | 1/1985 | Yanes | 222/88 |
| 4,846,236 | 7/1989 | Deruntz | 222/81 |
| 4,846,403 | 7/1989 | Mivalez | 141/330 |
| 5,152,428 | 10/1992 | Di Gerolamo | 222/325 |
| 5,280,764 | 1/1994 | Levinrad | 141/330 |
| 5,421,489 | 6/1995 | Holzner, Sr. et al. | 222/325 |
| 5,697,524 | 12/1997 | Sedlmeier | 222/82 |
| 5,730,327 | 3/1998 | Stern | 222/82 |

FOREIGN PATENT DOCUMENTS

| | | |
|---|---|---|
| 3 826 887 | 2/1990 | Germany . |
| 9 103 038 | 8/1992 | Germany . |

*Primary Examiner*—J. Casimer Jacyna
*Attorney, Agent, or Firm*—Foley & Lardner

[57] ABSTRACT

A device for emptying a film tube 15 containing a pasty substance comprises a cap structure 11 including a transverse wall 12 supporting the front end of the tube, a cylindrical flange 13 formed on the wall for receiving the front end of the tube, and a dispensing pipe 17. The pipe 17 extends from a recess 16 formed in the wall 12 and having an at least partially circular-cylindrical shape, with a spike 18 being integrally formed at the center of the recess and extending parallel to the axis of the tube. The tip 19 of the spike is retracted from the plane of the wall 12. When dispensing pressure is exerted on the tube 15, the portion of the tube film overlying the recess 16 will bulge into the recess, until its central part is scratched by the tip 19 of the spike and thus caused to burst. The content of the tube can then flow into the recess 16 surrounding the spike 18 and out through the pipe 17.

8 Claims, 2 Drawing Sheets

DEVICE FOR EMPTYING A FILM TUBE

BACKGROUND OF THE INVENTION

A device for emptying a film tube containing a pasty substance and having the features recited in the preamble of claim 1 is known from German Utility Model No. 9,103,038. In the known device, a blade with a face extending transversely of the radial direction of the tube is used for rupturing the tube. For emptying the tube, pressure is exerted on the rear end thereof, which pressure progresses through the tube content and urges the front end of the tube against the oblique edge of the blade. Due to this action, a fold present at the front end of the tube and extending outward from the center, is severed and the tube is opened.

For properly fulfilling its function with film tube materials used in practice, the known arrangement requires a comparatively sharp blade which is regularly obtained only by a separate piece of metal mounted in the cap. This increases the cost of the device, which is regularly formed as a disposable part.

When the blade is formed as a stationary element, it prevents a piston from being fully advanced for completely emptying the tube.

In a further device known from German Offenlegungsschrift No. 3,826,887, the film tube is punctured by a spike which must be manually inserted, prior to the emptying step, through a discharge pipe provided on the cap, and must be withdrawn thereafter. This manipulation is not only cumbersome and time-consuming but also involves the danger that the container content is discharged prematurely, thereby contaminating the surroundings and/or being itself inadmissibly contaminated by foreign substances. Moreover, the known device is unsuited for use in power-operated discharging apparatus.

SUMMARY OF THE INVENTION

It is the object of the invention to provide a device for emptying a film tube containing a pasty substance, which device ensures safe opening and complete emptying of the tube. Moreover, the device should be adapted for use with power-operated discharging apparatus.

To met this object, the invention provides a device for emptying a film tube containing a pasty substance, comprising a substantially rigid cap having a rear cylindrical flange for receiving an end of the tube, a transverse wall supporting the tube in the forward direction and having a dispensing opening, and means disposed in the dispensing opening for rupturing part of the tube film, wherein the rupturing means includes a tip facing the tube, the film being caused by the tip to burst while being over-stressed due to dispensing pressure exerted on the tube, wherein the tip in the emptied state of the tube does not substantially project beyond the transverse wall.

According to the invention, safe opening of the film tube is ensured even in case of films and pastes that are difficult to handle. The fact that the tip, in the empty condition of the tube, does not substantially project beyond a transverse wall which supports the tube, permits a complete emptying.

In a preferred embodiment, the tip is formed on a spike extending in the axial direction of the tube, the spike being disposed in a substantially cylindrical recess provided within the transverse wall and surrounding the dispensing opening. This provides an efficient operation while being inexpensive in manufacture.

In another embodiment, the top of the spike is offset into the recess from the plane of the transverse wall supporting the tube. If pressure is applied to the rear end of the tube, a portion thereof overlying a recess will deform into the recess until the central area of the film which is thereby over-stressed to the largest degree reaches the tip of a spike disposed within the recess and is thereby caused to burst. Rupturing of the over-stressed film results in a substantially larger opening than is achieved by merely punching or cutting it with a knife, which is advantageous for an unimpeded dispensing of the tube content.

The fact that the tip of the spike, in the emptied state of the film tube, is offset from the wall supporting the tube, permits complete emptying because the spike will not impede the dispensing piston. At the same time, this structure provides protection during shipping because the tube cannot reach the top of the spike without the minimum pressure required for opening being applied.

It is advantageous to reduce the axial length of the overall device as much as possible. To this end, the height of the spike is preferably less than half the depth of the recess.

In order to prevent the tube film during expansion from sliding into the recess in which case it would be possibly not over-stressed to a degree sufficient to burst by contact with the tip of the spike, it is preferred that the recess and the wall together form a substantially sharp edge, and also that the tube film and/or the surface of the wall supporting the tube is provided with anti-sliding means.

Preferably, the recess has a substantially circular cross-section substantially completely surrounding the tip of the spike. This will cause that portion of the tube film, which has been bulged and stressed to the largest degree, to come into contact with the tip of the spike.

It is advantageous that the bottom of the cap be made substantially flat, thus forming a structural part of low material requirement, yet ensuring a complete emptying.

In yet other embodiments of the present invention, the tip is formed by an oblique end of a cylindrical pipe which is coaxial with the dispensing opening and projects rearward beyond the plane of the transverse wall. The pipe may be axially movable under pressure to such an extent that its tip becomes substantially flush with the plane of the transverse wall. The pipe may be integrally connected to the cap at a rated breaking location, or may be biased with respect to the cap against the dispensing direction. In these embodiments, the film tube is opened by the tip of a pipe which guides the outflowing paste directly into the discharge opening of the cap.

The whole device may be manufactured as one integral part.

DETAILED DESCRIPTION OF PREFERRED EMBODIMENTS

Figure 1A:
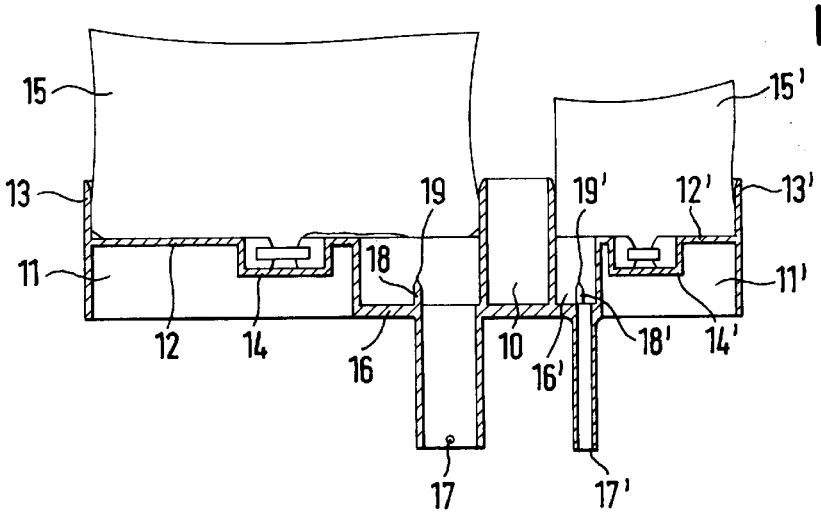
FIGS. 1*a* and 1*b* are an axial section and an end view of a device for emptying a film tube according to a first embodiment of the invention.
Figure 1B:
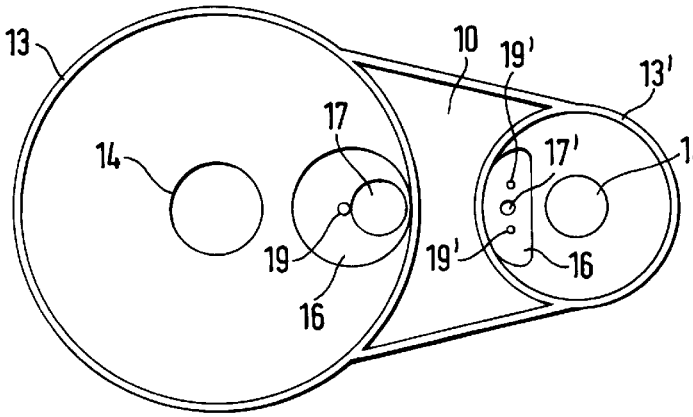

The device shown in FIGS. 1*a* and 1*b* consists of a cap structure including two cap portions 11, 11' integrally interconnected by an intermediate part 10. Either cap portion has a transverse wall 12, 12', a circular-cylindrical flange 13, 13' extending rearward (upward in FIG. 1*a*) from the wall, and a cylindrical-circular trough 14, 14' disposed centrally and projecting forward (upward in FIG. 1). Either cap portion 11, 11' receives the front end of a correspondingly dimensioned film tube 15, 15' which is glued to the flange 13, 13', with the trough 14, 14' receiving the front end of the tube which may be closed by a clip.

The thus completed unit, made up of a cap structure and two film tubes filled with pasty substances by the producer, is adapted to be place din an apparatus as disclosed, for instance, in European Patent Application Publication No. 0,492,413. The portions of the film tubes extending from the cap structure are inserted into a double cylinder arrangement. By advancing power-driven pistons in common, the two pastes can be dispensed at a mixing ratio corresponding to the cross-sectional ratio of the two tubes.

A forward (downward in FIG. 1) extending recess 16, 16' is provided in either wall 12, 12' with a dispensing pipe 17, 17' being connected to the bottom of either recess.

The recess 16 has a circular-cylindrical cross-section and surrounds a centrally disposed spike 18 the tip 19 of which is set back from the plane of the wall 12. Preferably, the length of the spike 18 is less than half the depth of the recess 16. The spike 18 is located immediately next to the opening of the pipe 17.

The circular cross-sectional shape of the recess 16 referred to above is a preferred embodiment. Depending on the film material, the tube content and the number of spikes 18 provided in the recess, other, e.g. oval, cross-sectional shapes may be used.

Figure 2:
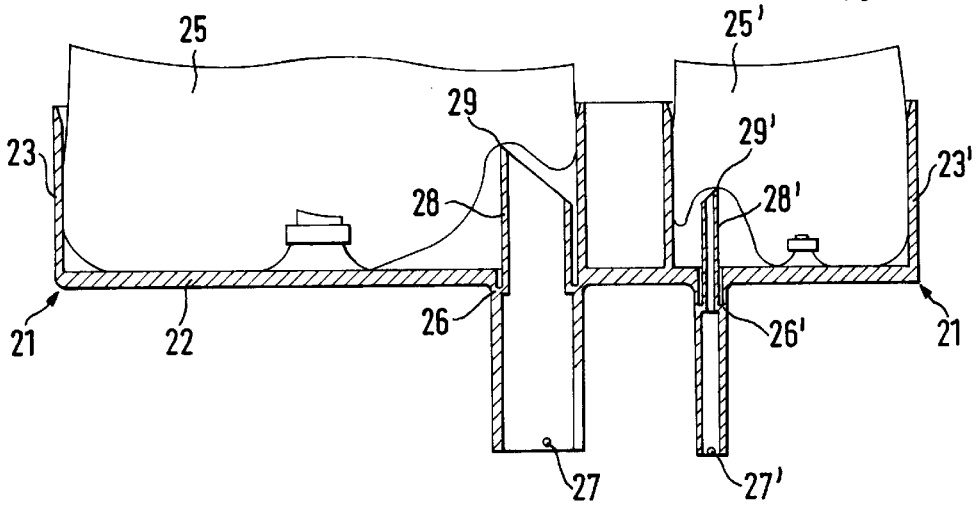
FIGS. 2 and 3 are axial sections of a second and a third embodiment.

At the bottom of the recess 16', two spikes 18' are integrally formed at both sides of the opening of the pipe 17'. The tips 19' of the spikes 18' are also offset from the plane of the wall 12'. As seen in FIG. 2, the recess 16' has an overall segment-type shape.

When the above-mentioned pistons are first advanced, the dispensing pressure causes the part of the film tube 15, 15' overlying the respective recess 16, 16' to start bulging into the recess until it reaches the spike tip 19, 19' and is thereby caused to burst. The length of the spikes 18, 18' is selected in relation to the depth of the recess 16, 16' and in view of the film material in such a manner that the spike tip 19, 19' is contacted only when the film has been over-stressed to a degree sufficient for the film to burst and to form as large an opening as possible. In this way, unimpeded flow of the tube content into the recess 16, 16' and from there into the dispensing pipe 17, 17' is enabled.

The recess 16, 16' and the surface of the wall 12, 12' together form an edge that is rounded as little as possible and is essentially sharp—to the extent it does not damage the film—to prevent the tube film from sliding. To the same and, the surface of the wall 12, 12' supporting the tube 15, 15' may be roughened and/or the film may be coated or otherwise provided with anti-sliding means.

In an alternative embodiment (not shown in the drawings) the spikes 18, 18' are so long that their tips lie within the plane of the respective wall 12, 12'.

The device of FIG. 2 differs from that of FIGS. 1*a* and 1*b* in that the tip 29, 29' which scratches the film tube is formed at the end of an obliquely cut cylindrical pipe 28, 28' which has its other end coaxially extending into the corresponding dispensing pipe 27, 27' and integrally connected thereto at a rated breaking location 26, 26'.

In manufacturing and filling the film tubes 25, 25', care is taken that they lie loosely within the area of the pipes 28, 28' and the respective tip 29, 29' does not contact the tube with more than negligible pressure. When the dispensing piston is advanced, this pressure increases until the tip scratches the film tube and causes it to burst. The tube content will then flow through the pipe 28, 28', which forms the tip 29, 29', and directly into the dispensing pipe 27, 27'.

When the dispensing piston reaches the respective tip 29, 29', further advancing movement causes the rated breaking location 26, 26' to break and the pipe 28, 28' to move into the dispensing pipe 27, 27'. Complete emptying of the tube is thus ensured.

The force required to break the rated location 26, 26' is selected in consideration of the properties, specifically the toughness, of the tube films used and of the properties, particularly the viscosity, of the tube contents such as to be larger than the force required for the tip 29, 29' to cause the tube to burst.

In the embodiment of FIG. 2—different form FIG. 1*a*—the film tubes 25, 25' are provided with closures turned inward so that the troughs 14, 14' provided in the embodiment of FIGS. 1*a* and 1*b* are unnecessary. This results in a simpler design of the transverse walls 22, 22', even though it may be less advantageous from the standpoint of completely emptying of the tubes. Therefore, the trough-shape of the transverse walls adopted in the first embodiment may be used also in that of FIG. 2 Conversely, the design of FIG. 2 may be used in the embodiment of FIGS. 1*a* and 1*b*.

Figure 3:
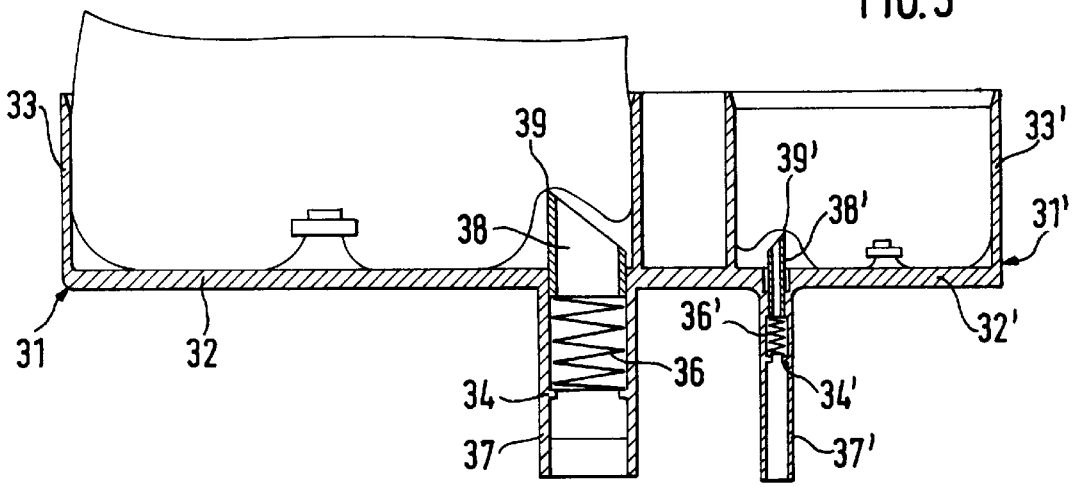

The embodiment of FIG. 3 is largely similar to that of FIG. 2. In this case, however, the pipes 38, 38' are not connected to the cap portions 31, 31' at rated breaking locations but are resiliently biased against the dispensing directions. The bias results form a respective spring 36, 36' which is supported at a ledge 34, 34' provided inside the dispensing pipe 37, 37'.

Again, the force of the spring 36, 36' is so selected that, when the dispensing piston is advanced, the pressure exerted on the tube film 35, 35' by the pipe tip 39, 39' is sufficient to scratch the tube and cause it to burst.

In the final emptying phase, the piston directly contacts the respective pipe 38, 38' and pushes it against the bias of the spring 36, 36' into the dispensing pipe 37, 37' to such an extent that the tube can be completely emptied.

Figure 4A:
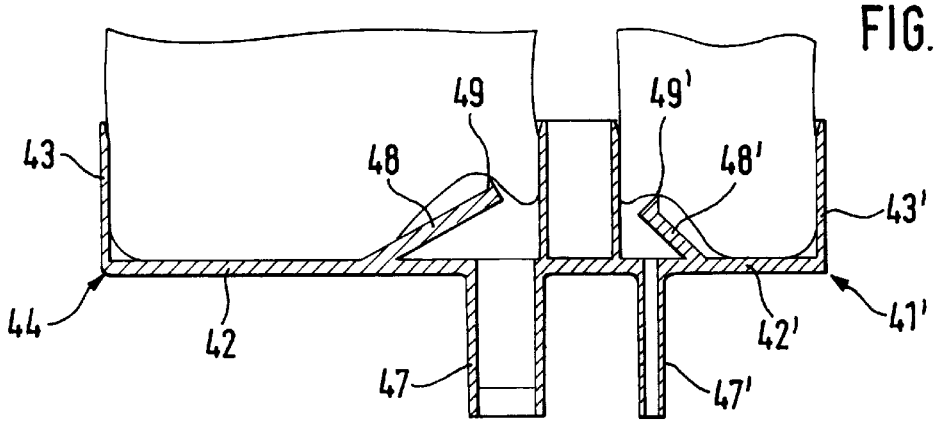
FIGS. 4*a* and 4*b* are an axial section and an end view of a fourth embodiment of the invention.
Figure 4B:
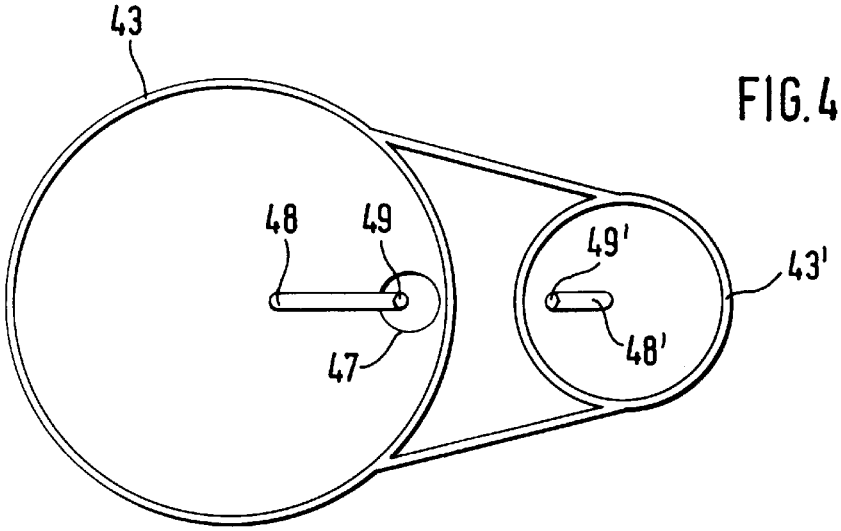

In the embodiment of the invention according to FIGS. 4*a* and 4*b*, the tip 49, 49' acting on the tube film is provided at the end of a lever 48, 48', which is integrally formed on the transverse wall 42, 42' and, in its non-loaded condition, extends upward at an angle from the wall 42, 42'. In this condition, the tip 49, 49' is located at or near the axis of the respective dispensing pipe 47, 47'.

When the dispensing piton is advanced, the respective film tube 45, 45' is pressed against the tip 49, 49' so as to be scratched thereby and caused to burst. At least by the time the dispensing pistons have been completely advanced, the levers 48, 48' will lie substantially flat on the walls 42, 42' so as not to impede the complete emptying of the tubes.

In order to prevent the lever 48' in the right cap portion 41' in FIGS. 4*a* and 4*b*, which is provided with the comparatively narrow dispensing pipe 47', from blocking the opening of the pipe, the lever 48' may be slightly displaced from the axis of the pipe 47', different from what is shown in FIG. 4*b*.

In FIG. 4*a*, the two film tubes 45, 45' are shown without any specific end closures. These may be shaped as in FIG. 1*a* or as in FIGS. 2 and 3, and the walls 42, 42' may be provided, if necessary, with trough-like formations similar to FIG. 1*a*.

In the embodiments described above, the cap structure is shaped for receiving two film tubes in common. The invention may be likewise adopted in cases in which one cap structure is provided for three or more tubes or in which each one of a plurality of tubes is provided with a separate cap or in which a single tube with one cap is provided.

The invention claimed is:

1. A device for emptying a film tube, comprising:

said film tube;

a substantially rigid cap for having a rear cylindrical flange for receiving an end portion of said film tube;

a transverse wall supporting said film tube in a forward direction and having a dispensing opening;

a substantially cylindrical recess provided in said transverse wall and surrounding said dispensing opening; and means fixed within said recess for rupturing a part of said film tube, the rupturing means including a pointed tip which is offset from the plane of said transverse wall into said recess and faces said film tube such that dispensing pressure exerted on said film tube causes said film tube to bulge into said recess until it reaches said tip and is thereby ruptured.

2. The device of claim 1, wherein said tip is formed on a spike extending in an axial direction of said tube.

3. The device of claim 2, wherein the height of said spike is less than half the depth of said recess.

4. The device of claim 1, wherein said recess and said transverse wall together form a substantially sharp edge.

5. The device of claim 1, wherein said tube film is provided with anti-sliding means.

6. The device of claim 1, wherein the surface of the wall supporting said tube is provided with anti-sliding means.

7. The device of claim 1, wherein said recess has a substantially circular cross-section substantially completely surrounding the tip of said spike.

8. The device of claim 1, wherein the end portion of the film tube is fixed to said cap.

* * * * *